US012742232B2

(12) United States Patent
Valdez et al.

(10) Patent No.: US 12,742,232 B2
(45) **Date of Patent: *Sep. 22, 2026**

(54) METHOD OF FORMING AND HEAT TREATING COILED TUBING

(71) Applicant: TENARIS COILED TUBES, LLC, Houston, TX (US)

(72) Inventors: Martin Valdez, Buenos Aires (AR); Bruce A. Reichert, Houston, TX (US); Jorge Mitre, Houston, TX (US)

(73) Assignee: Tenaris Coiled Tubes, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/627,877

(22) Filed: Apr. 5, 2024

(65) Prior Publication Data

US 2024/0247351 A1 Jul. 25, 2024

Related U.S. Application Data

(60) Continuation of application No. 16/685,333, filed on Nov. 15, 2019, now Pat. No. 11,952,648, which is a (Continued)

(51) Int. Cl.

| | |
|---|---|
| ***C22C 38/38*** | (2006.01) |
| ***C21D 6/00*** | (2006.01) |
| ***C21D 8/10*** | (2006.01) |
| ***C21D 9/08*** | (2006.01) |
| ***C21D 9/14*** | (2006.01) |

(Continued)

(52) U.S. Cl.

CPC ..... *C22C 38/38* (2013.01); *C21D 6/002* (2013.01); *C21D 6/005* (2013.01); *C21D 6/008* (2013.01); *C21D 8/10* (2013.01); *C21D 9/08* (2013.01); *C21D 9/085* (2013.01); *C21D 9/14* (2013.01); *C22C 38/02* (2013.01); *C22C 38/04* (2013.01); *C22C 38/06* (2013.01); *C22C 38/26* (2013.01); *C22C 38/28* (2013.01); *C22C 38/32* (2013.01); *E21B 17/20* (2013.01)

(58) Field of Classification Search

None

See application file for complete search history.

(56) References Cited

U.S. PATENT DOCUMENTS

| | | | | |
|---|---|---|---|---|
| 4,629,218 | A * | 12/1986 | Dubois | E21B 17/20 138/155 |
| 2006/0157539 | A1* | 7/2006 | DuBois | B21C 37/08 228/103 |
| 2010/0136363 | A1* | 6/2010 | Valdez | B22D 11/111 164/55.1 |

OTHER PUBLICATIONS

CYMAX (Year: 1993).*

(Continued)

*Primary Examiner* — Jenny R Wu

(74) *Attorney, Agent, or Firm* — Morgan, Lewis & Bockius LLP

(57) ABSTRACT

Described herein are coiled tubes with improved and varying properties along the length that are produced by using a continuous and dynamic heat treatment process (CDHT). Coiled tubes can be uncoiled from a spool, subjected to a CDHT process, and coiled onto a spool. A CDHT process can produce a "composite" tube such that properties of the tube along the length of the tube are selectively varied. For example, the properties of the tube can be selectively tailored along the length of the tube for particular application for which the tube will be used.

20 Claims, 6 Drawing Sheets

Related U.S. Application Data continuation of application No. 14/872,490, filed on Oct. 1, 2015, now Pat. No. 10,480,054, which is a division of application No. 13/229,517, filed on Sep. 9, 2011, now Pat. No. 9,163,296.

(60) Provisional application No. 61/436,156, filed on Jan. 25, 2011.

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |
| ***E21B 17/20*** | (2006.01) |

(56) References Cited

OTHER PUBLICATIONS

Metallurgical and Materials Transactions A; A Kinetics Model for Martensite Transformation in Plain Carbon and Low-Alloyed Steels; Seok-Jae Lee and Chester J. Van Tyne; 422—vol. 43A, Feb. 2012; Copyright Teh Minterals, Metals & Materials Society and ASM International 2011.

ASM Handbook, Martensitic Structures; vol. 9; Metallography and Microstructures; G.F. Vander Voort, editor, p. 165-178, Copyright 2004 ASM International.

ASM Handbook, Microstructures, Processing, and Properties of Steels; vol. 1, George Krauss, Advanced Steel Processing and Products Research Center, Colorado School of Mines; Copyright 1990 ASM International.

* cited by examiner

METHOD OF FORMING AND HEAT TREATING COILED TUBING

CROSS-REFERENCE TO RELATED APPLICATIONS

This application is a continuation of U.S. patent application Ser. No. 16/685,333, filed Nov. 15, 2019, which is a continuation of U.S. patent application Ser. No. 14/872,490, filed Oct. 1, 2015, now U.S. Pat. No. 10,480,054, which is a division of U.S. patent application Ser. No. 13/229,517, filed Sep. 9, 2011, now U.S. Pat. No. 9,163,296, which claims the benefit of U.S. Provisional Application No. 61/436,156, filed Jan. 25, 2011, the entirety of which is hereby incorporated by reference.

BACKGROUND OF THE INVENTION

Field of the Invention

Embodiments of the present disclosure are directed toward coiled tubes and methods of heat treating coiled tubes. Embodiments also relate to coiled tubes with tailored or varied properties along the length of the coiled tube.

Description of the Related Art

A coiled tube is a continuous length of tube coiled onto a spool, which is later uncoiled while entering service such as within a wellbore. Coiled tubes may be made from a variety of steels such as stainless steel or carbon steel. Coiled tubes can, for example, have an outer diameter between about 1 inch and about 5 inches, a wall thickness between about 0.080 inches and about 0.300 inches, and lengths up to about 50,000 feet. For example, typical lengths are about 15,000 feet, but lengths can be between about 10,000 feet to about 40,000 feet.

Coiled tubes can be produced by joining flat metal strips to produce a continuous length of flat metal that can be fed into a forming and welding line (e.g., ERW, Laser or other) of a tube mill where the flat metal strips are welded along their lengths to produce a continuous length of tube that is coiled onto a spool after the pipe exits the welding line. In some cases, the strips of metal joined together have different thickness and the coiled tube produced under this condition is called "tapered coiled tube" and this continuous tube has varying internal diameter due to the varying wall thickness of the resulting tube.

Another alternative to produce coiled tubes includes continuous hot rolling of tubes of an outside diameter different than the final outside diameter (e.g., U.S. Pat. No. 6,527,056 B2 describes a method producing coiled tubing strings in which the outer diameter varies continuously or nearly continuously over a portion of the string's length, WO2006/078768 describes a method in which the tubing exiting the tube mill is introduced into a forging process that substantially reduces the deliberately oversized outer diameter of the coil tubing in process to the nominal or target outer diameter, and EP 0788850 describes an example of a steel pipe-reducing apparatus, the entirety of each of which is hereby incorporated by reference, describe such tubes).

These methods described above produce coiled tube having constant properties since the tube is produced with the same material moving continuously through the same process. Therefore, the final design of the produced tube (e.g., dimension and properties) is a compromise between all the tube requirements while in service.

SUMMARY

Described herein are coiled tubes with improved and varying properties along the length. In some embodiments, the coiled tubes may be produced by using a continuous and dynamic heat treatment process (CDHT). The resulting new product is a "composite" tube in the sense that the properties are not constant, generating a composite coiled tube (e.g., a continuous length of tube that can be coiled onto a spool for transport and uncoiled for use) with unique and optimized properties. The production of a continuous length of composite coil tube may be performed by introducing a previously produced spool of such product into a continuous and dynamic heat treatment line in order to generate a new material microstructure. The heat treatment is continuous because the tube moves through subsequent heating and cooling processes and it is dynamic because it can be modified to give a constantly changing heat treatment to different sections of the coiled tube.

Continuous coil tube may be made from shorter lengths of flat metal strip which are joined end-to-end, formed into tubular form, and seam welded to produce the starting coiled tube for the process are described herein. The starting coiled tube is thereafter introduced into a CDHT process. The CDHT modifies the microstructure thereby improving properties and minimizing heterogeneous properties between the tube body, the longitudinal weld, and the welds made to join the flat metal strips.

The heat treatment variables can be modified continuously in order to generate different mechanical properties, corrosion resistance properties, and/or microstructures along the length of the coiled tube. The resulting composite coiled tube could have localized increase in properties or selected properties in order to allow working at greater depths, localized increased stiffness to minimize buckling, increased corrosion resistance locally in the areas where exposure to higher concentrations of corrosive environments is expected, or any tailored design that has variation of properties in a specific location.

This variation of properties can result in a minimization or reduction of tapers, improving fatigue life, keeping the internal diameter constant for longer distances, minimizing unnecessary strip-to-strip welds, decreasing weight, improving inspection capabilities, tube volume and capacity among others. In particular, weight can be reduced by having an average wall thickness of the tube less than a tube with tapers since a tapered tube has increased wall thickness in certain regions such as the sections of tube at the top of a well. The outer diameter (OD) of the tapered tube typically remains constant while the inner diameter (ID) of the tube is changed to change the wall thickness. For example, an increase in wall thickness of a section of tube can decrease the ID of the section of tube. Therefore, a tube without tapering can have an ID that is substantially the same throughout the tube. By having a substantially constant ID, the ID along the entire length of tube can be inspected. For example, to inspect the ID, a drift ball can be used. However, the drift ball can only be used to inspect the smallest ID of the tapered tube. In addition, fluid flow rate through a tapered tube (e.g., capacity) is limited to the smallest ID of the tube. Therefore, by not reducing ID in certain sections of the tube by increasing wall thickness, the volume and capacity of the tube can be increased.

In certain embodiments, a method of treating a tube is provided. The method can include providing a spool of the tube, uncoiling the tube from the spool, heat treating the uncoiled tube to provide varied properties along a length of the uncoiled tube, and coiling the tube after heat treating. The varied properties may include mechanical properties. At least one of temperature, soak time, heating rate, and cooling rate can be varied during heat treating of the uncoiled tube to provide varied properties along the length of the uncoiled tube. In certain embodiments, the tube is heat treated with two or more heat treatments (e.g., a double quench and tempering process). The tube may have a substantially constant wall thickness throughout the tube. The tube may have fewer changes in wall thickness as a result of the varied properties along the length of the tube in comparison to conventional tube without the varied properties to maintain sufficient properties for a particular application.

In certain embodiments, a coiled tube is provided. The coiled tube includes a first substantial portion of the tube having a first set of properties and a second substantial portion of the tube having a second set of properties such that at least one property of the first set of properties is different from at least one property of the second set of properties. For example, the difference between at least one property of the first set of properties and at least one property of the second set of properties can be larger than general variations in at least one property as a result of substantially similar steel composition with substantially similar heat treatment processing. At least one property of the first and second set of properties may include yield strength, tensile strength, fatigue life, corrosion resistance, grain size, or hardness. For example, the first substantial portion of the tube can include a first yield strength and the second substantial portion of the tube can include a second yield strength different (e.g., less or greater) than the first yield strength.

The tube may have fewer changes in wall thickness as a result of the varied properties along the length of the tube in comparison to conventional tube without the varied properties to maintain sufficient properties for a particular application. The tube may have a substantially constant wall thickness throughout the tube. Furthermore, the tube can have a substantially uniform composition throughout the tube. The tube may include a plurality of tube sections welded together and at least a portion of one of the tube sections of the plurality of tube sections comprises the first substantial portion and at least another portion of the same tube section comprises the second substantial portion.

In certain embodiments, a coiled tube for use in a well is provided. The coiled tube can include a continuous length of tube comprising a steel material having a substantially uniform composition along the entire length of the tube. The tube has at least a first portion configured to be positioned at the top of the well and at least a second portion configured to be positioned toward the bottom of the well relative to the first portion. The first portion of tube has a first yield strength and the second portion of tube has a second yield strength, the first yield strength can be different (e.g., greater or less) than the second yield strength. In some embodiments, the first portion has a yield strength greater than 100 ksi or about 100 ksi and the second portion has a yield strength less than 90 ksi or about 90 ksi. In further embodiments, the tube further includes a third portion of tube having a third yield strength between that of the first and second yield strength, the third portion being located between the first and second portions. However, the CDHT allows for the production of numerous combinations of properties (e.g. YS) for any length of pipe.

The tube can have a length of between 10,000 feet and 40,000 feet (or between about 10,000 feet and about 40,000 feet). The first portion of tube may have a length of between 1,000 feet (or about 1,000 feet) and 4,000 feet (or about 4,000 feet). Furthermore, the tube may include a plurality of tube sections welded together, and each of the tube sections may have a length of at least 1,500 feet (or about 1,500 feet). The length of each tube section is related to the distance between bias welds to form the tube. The tube sections may be welded together after being formed into tubes or may be welded together as flat strips which are then formed into the tube. The tube may have a substantially constant wall thickness. For example, the first portion includes a first wall thickness and the second portion includes a second wall thickness that can be substantially the same as the first wall thickness. The first portion includes a first inner diameter and the second portion includes a second inner diameter that can be substantially the same as the first inner diameter.

In some embodiments, the tube has an outer diameter between 1 inch and 5 inches (or between about 1 inch and about 5 inches). The tube may have a wall thickness between 0.080 inches and 0.300 inches (or between about 0.080 inches and about 0.300 inches). In further embodiments, the tube has a substantially constant wall thickness along the entire length of the tube. The tube may have a substantially constant inner diameter along the entire length of the tube. The tube may have no taperings in some embodiments, while in other embodiments, the tube has at least one taper.

DETAILED DESCRIPTION

Described herein are coiled tubes having varying properties along the length of the coiled tube and methods of producing the same. In certain embodiments, a continuous and dynamic heat treatment process (CDHT) can be used to produce coiled tube with varying properties along the length of the coiled tube. The heat treatment is continuous because the tube moves through subsequent heating and cooling processes, and the heat treatment is dynamic because it can be modified to give a constantly changing heat treatment to different sections of the coiled tube.

The heat treatment variables can be modified continuously in order to generate different mechanical properties along the length of the coiled tube. The resulting composite coiled tube can have at least a first portion of the tube having a first set of properties and a second portion of the tube having a second set of properties such that at least one property of the first set of properties is different from at least one property of the second set of properties.

In many applications, the coiled tube will be hanging inside a well and the coiled tube should be strong enough to support the associated axial loads; in other applications, the coiled tube will be pushed inside a well and when removed, the coiled tube will be pulled against the friction forces inside the well. In these examples, the material of the coiled tube on the top of the well will be subjected to the maximum axial load. In addition, for a deeper well, the wall thickness on the upper part of the coiled tube may be increased in order to withstand the axial load (both from hanging or pulling). The use of tapered tubes has been used to allow increasing wall thickness only in the upper part of the coiled tube in order to reduce the total weight of the coiled tube. Materials of different compositions with higher mechanical properties have also been used in order to increase the resistance of the axial load, but these materials tend to be more expensive, more difficult to process, and have lower corrosion resistance.

In other applications, the coiled tube is pushed inside the well and there may be a requirement for increased stiffness; then the specification for the tube may require increased mechanical properties in order to maximize the stiffness of the coiled tube. In other cases, some areas of the well experience different temperatures and corrosive environments, and the coiled tube is specified with resistance to corrosive environments. Increased corrosion resistance can be produced by decreasing other material properties such as mechanical properties, which is contrary to the objective of increase axial resistance and stiffness.

Figure 1:
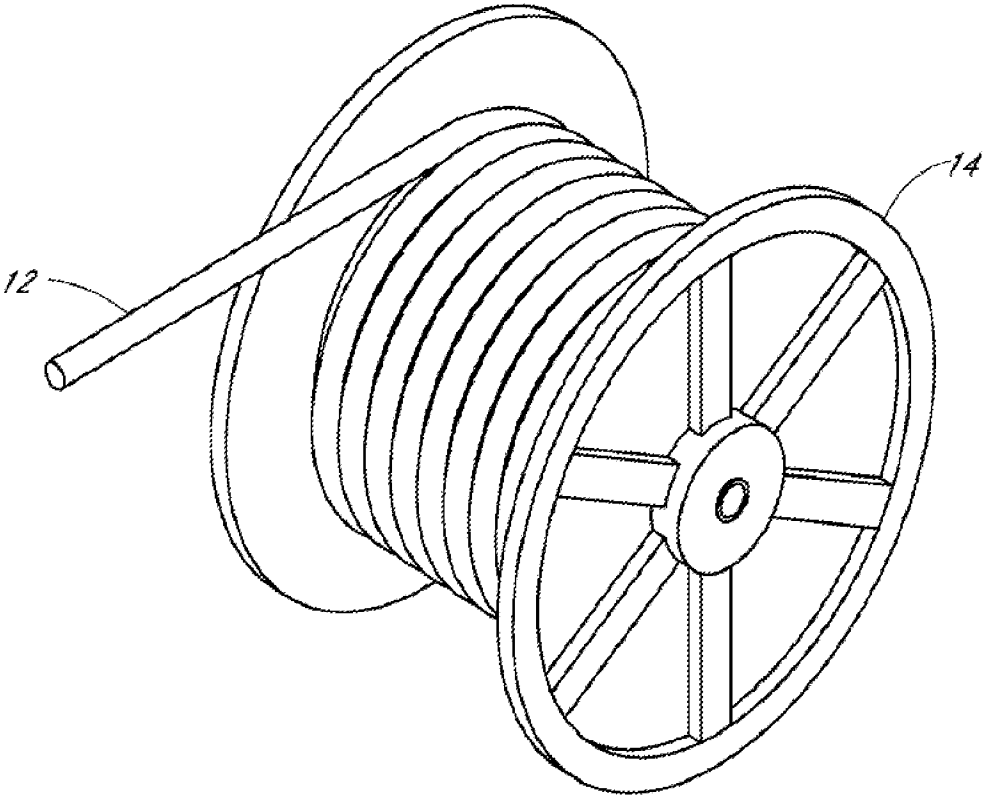
FIG. 1 illustrates an example coiled tube on a spool.
Figure 2:
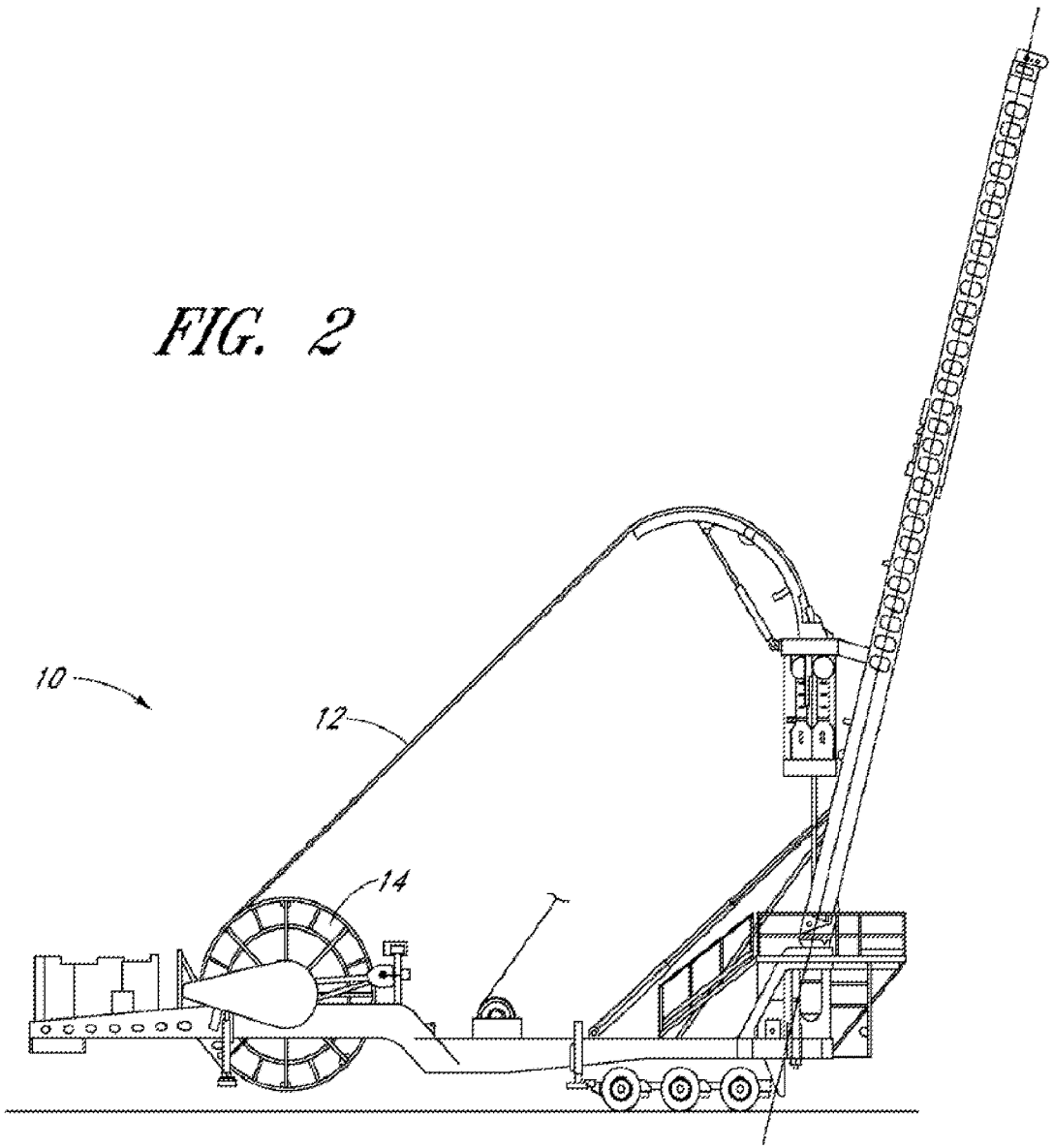
FIG. 2 illustrates an example rig configured to coil and uncoil tube from a spool.

Coiled tube is used by service companies that will provide a service in one location and then remove the coiled tube, recoil it and move it to a different location. FIG. 1 illustrates an example coiled tube 12 on a spool 14, and FIG. 2 illustrates an example rig 10 that can coil and un-coil coiled tube 12 on a spool 14 and direct the tube 12 into a well. The performance and fatigue life of the tube is related to low cycle fatigue associated with the coiling and un-coiling of the tube in each service operation. The fatigue life is usually reduced in the areas where the flat metal was originally joined. Also, the fatigue life is affected by the mechanical properties and operative conditions of the welding process.

Described herein is a product in which, by a special process, the coiled tube can be produced as a "composite" tube, in which the best properties for each section of the coiled tube are targeted. In this way, the tube properties are tailored along the length of the tube to generate the desired properties in the right place resulting in an overall increase of life due to fatigue, increase in corrosion resistance, and minimization of weight.

The special process (e.g., CDHT) takes advantage of the fact that material properties can be varied with appropriate heat treatments. Since a heat treatment is basically combinations of temperature and time, in a continuous heat treatment process, the temperature and speed (including heating and cooling rates) could be dynamically varied in order to modify the final properties of virtually every section of the tube being treated. Another advantage of the process is that since the final properties are affected by the final temperature and time cycle, the properties of the coiled tube could be fixed (e.g., repaired) if there has been a problem during the process, the heat treatment could be used to refurbish already used coiled tube if severe but reversible damage had occurred, or the heat treatment could be used to change properties of already produced coiled tube. This type of treatment allows the service companies to specify the best coiled tube for a given operation regardless of the number of wells the coiled tube is planned to operate in. If the tailored coiled tube does not find more wells to service and it is obsolete (e.g., the coiled tube does not have properties for available applications), its properties could be changed provided there is no irreversible damage to the coiled tube. In this way, the process (e.g., CDHT) described herein can generate a unique product (e.g., coiled tube) that could act as new product, new process for operation, and a new service. For example, the unique product can open up the possibility for a new "service" for repairing old coiled tubes or changing properties.

Figure 3:
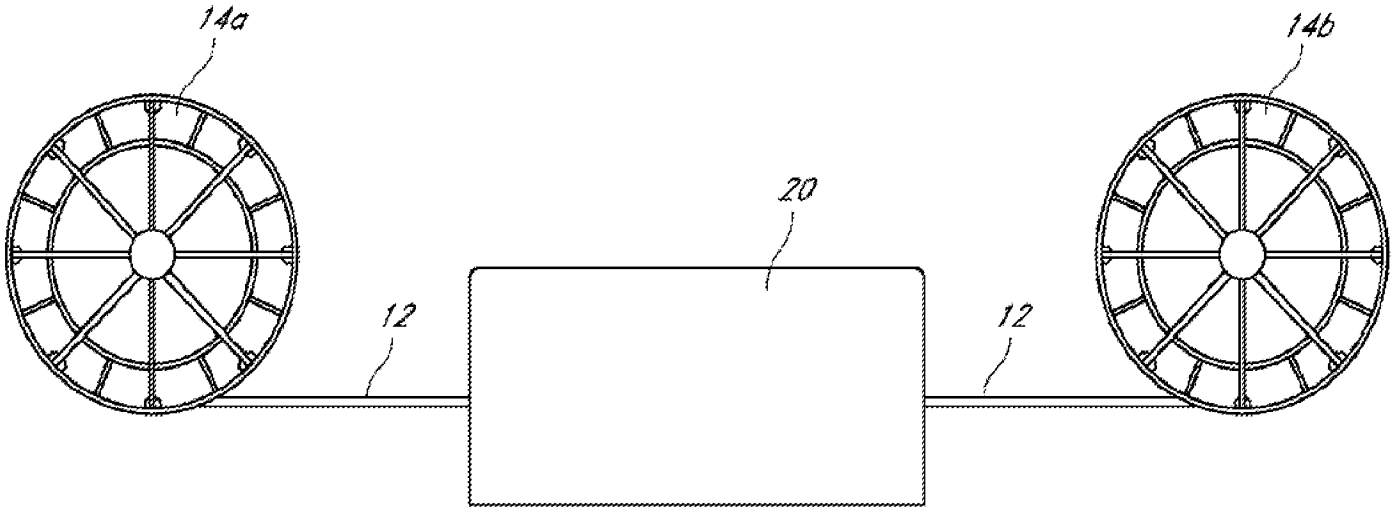
FIG. 3 illustrates an example of a continuous and dynamic heat treatment process.

In certain embodiments, a method of treating a tube includes providing a spool of the tube, uncoiling the tube from the spool, heat treating the uncoiled tube to provide varied properties along a length of the uncoiled tube, and coiling the tube after heat treating. FIG. 3 is a schematic that illustrates one embodiment. Tube 12 is uncoiled from a first spool 14*a*. After being uncoiled, the tube 12 goes through a CDHT process represented by box 20 and is then re-coiled on a second spool 14*b*.

In certain embodiments, the varied properties include mechanical properties. For example, the mechanical properties can include yield strength, ultimate tensile strength, elastic modulus, toughness, fracture toughness, hardness, grain size, fatigue life, fatigue strength. Many mechanical properties are related to one another such as fracture toughness, hardness, fatigue life, and fatigue strength are related to tensile properties.

The varied properties may include corrosion resistance. Corrosion resistance can include sulfide stress cracking (SSC) resistance. Hydrogen sulfide (H.sub.2S) dissolves in fluid (e.g., H.sub.2O), and the corrosive environment can be measured by pH and the amount of H.sub.2S in solution. Generally, the higher the pressure, the more H.sub.2S can be in solution. Temperature may also have an effect. Therefore, deeper locations in the well experience higher pressure and higher H.sub.2S concentrations. As such, corrosion resistance of the tube can be increased along the length of the tube toward the section of tube at the bottom of the well. For example, about the bottom 75% of the well generally has the worst corrosive environment. Therefore, in certain embodiments, the bottom 75% of the length of tube has lower mechanical properties and hence higher corrosion resistance properties than the top 25% of the length of tube.

In general, corrosion resistance is related to mechanical properties. For example, international standard NACE MR0175/ISO 155156 "Petroleum and natural gas industries-Materials for use in H.sub.2S-containing environments in oil and gas production" in Appendix A (A.2.2.3 for Casing and Tubing), the entirety of which is hereby incorporated by reference, shows a direct correlation of corrosion resistance to mechanical properties. In particular, Appendix A lists some materials that have given acceptable performance for resistance to SSC in the presence of H.sub.2S, under the stated metallurgical, environmental and mechanical conditions based on field experience and/or laboratory testing. Appendix A indicates that as severity of the environment increases from region 1 to region 3 (increase H.sub.2S partial pressure and/or pH decreases), the recommendation for maximum yield strength (YS) decreases. For example, for region 1 of low severity YS<130 ksi (HRC<30), for region 2 of medium severity YS<110 ksi (HRC<27) and for region 3 of high severity (HRC<26 or maximum API5CT grade is T95 with HRC<25.4), suitable recommended material in all regions can be Cr—Mo quench and tempered steels.

Table I compares a standard steel product used for a coiled tube that has a ferrite and pearlite microstructure and varying grain size with steel that is quench and tempered. Corrosion resistance of the quench and tempered steel is better than the standard product due to the uniformity of microstructure. Corrosion resistance of 80 ksi to 110 ksi coiled tube decreases as indicated, for example, in ISO 15156.

TABLE I

| | | Grade 80 (YS ≈ 85 ksi) | Grade 90 (YS ≈ 95 ksi) | Grade 110 (YS ≈ 115 ksi) | Corrosion Resistance (due to microstructure) |
|---|---|---|---|---|---|
| Product Type | Standard Product | Ferrite + Pearlite + Bainite Grain Size (GS) 80 > GS 90 > GS 110 | | | Low (non-uniform microstructure) |
| | Quench and Tempered | Tempered Martensite Carbide Size (CS) 80 > CS 90 > CS 110 Dislocation Density 80 < 90 < 110 | | | High (uniform microstructure) |
| Corrosion Resistance (due to YS) | | High | Medium | Low | |

During heat treatment, the microstructure will change from ferrite and pearlite to tempered martensite in the case of a quench and tempered process. A microstructure from a quench and tempered process is recommended by NACE for high strength pipes with SSC resistance. Also, carbide refinement due to tempering increases toughness. Localized hardness variations are reduced due to the elimination of pearlite or even bainite colonies that can result from segregation in as-rolled material. Localized increased hardness is detrimental for corrosion resistance. Fatigue life can also be increased by reduction of welds between sections of the tube, improving microstructure of the weld area through heat treatment, and/or reduction of mechanical properties.

A variety of steel compositions can be used in the methods described herein. Furthermore, various steel compositions can be used in the quench and temper process. Steel compositions can include, for example, carbon-manganese, chromium, molybdenum, boron and titanium, or a combination thereof. The steel composition may be selected based on, for example, the line speed, water temperature and pressure, product thickness, among others. Example steel compositions include:

Chromium bearing steel: the coiled tube comprising 0.23 to 0.28 wt. % (or about 0.23 to about 0.28 wt. %) carbon, 1.20 to 1.60 wt. % (or about 1.20 to about 1.60 wt. %) manganese, 0.15 to 0.35 wt. % (or about 0.15 to about 0.35 wt. %) silicon, 0.015 to 0.070 wt. % (or about 0.015 to about 0.070 wt. %) aluminum, less than 0.020 wt. % (or about 0.020 wt. %) phosphorus, less than 0.005 wt. % (or about 0.005 wt.) % sulfur, and 0.15 to 0.35 wt. % (about 0.15 to about 0.35 wt. %) chromium;

Carbon-Manganese: the coiled tube comprising 0.25 to 0.29 wt. % (or about 0.25 to about 0.29 wt. %) carbon, 1.30 to 1.45 wt. % (or about 1.30 to about 1.45 wt. %) manganese, 0.15 to 0.35 wt. % (or about 0.15 to about 0.35 wt. %) silicon, 0.015 to 0.050 wt. % (or about 0.015 to about 0.050 wt. %) aluminum, less than 0.020 wt. % (or about 0.020 wt. %) phosphorus, and less than 0.005 wt. % (or about 0.005 wt. % sulfur);

Boron-Titanium: the coiled tube comprising 0.23 to 0.27 wt. % (or about 0.23 to about 0.27 wt. %) carbon, 1.30 to 1.50 wt. % (or about 1.30 to about 1.50 wt. %) manganese, 0.15 to 0.35 wt. % (or about 0.15 to about 0.35 wt. %) silicon, 0.015 to 0.070 wt. % (or about 0.015 to about 0.070 wt. %) aluminum, less than 0.020 wt. % (or about 0.020 wt. %) phosphorus, less than 0.005 wt. % (or about 0.005 wt. %) sulfur, 0.010 to 0.025 wt. % (or about 0.010 to about 0.025 wt. %) titanium, 0.0010 to 0.0025 wt. % (or about 0.0010 to about 0.0025 wt. %) boron, less than 0.0080 wt. % (or about 0.0080 wt. %) N and a ratio of Ti to N greater than 3.4 (or about 3.4); and Martensitic Stainless Steel: the coiled tube comprising 0.12 wt. % (or about 0.12 wt. %) carbon, 0.19 wt. % (or about 0.19 wt. %) manganese, 0.24 wt. % (or about 0.24 wt. %) Si, 11.9 wt. % (or about 11.9 wt. %) chromium, 0.15 wt. % (or about 0.15 wt. %) columbium, 0.027 wt. % (or about 0.027 wt. %) molybdenum, less than 0.020 wt. % (or about 0.020 wt. %) phosphorus, and less than 0.005 wt. % (or about 0.005 wt. %) sulfur.

Molybdenum could be added to the steel compositions above, and some steel compositions can be combined B—Ti—Cr to improve hardenability. Described in Example 1 in the below examples is a chromium bearing steel.

In certain embodiments, at least one of temperature, soak time, heating rate, and cooling rate is varied during heat treating of the uncoiled tube to provide varied properties along the length of the uncoiled tube.

In certain embodiments, the tube has fewer changes in wall thickness as a result of the varied properties along the length of the tube in comparison to conventional tube without the varied properties in order to maintain sufficient properties for a particular application. The tube may even have a substantially constant wall thickness throughout the tube (e.g., the tube has no tapers). The flat metal strips that are used to form tube sections of the tube can be, for example, between 1,500 feet and 3,000 feet (or about 1,500 feet and about 3,000 feet). Flat metal strips with smaller thickness may be longer than flat metal strips with larger thickness. However, if additional changes in wall thicknesses are desired, the flat metal strips may be shorter to allow for additional changes in wall thickness. Thus, if the length of the flat metal strip needed for each change in wall thickness is shorter than the possible maximum length of the flat metal strip, an extra weld joint is required. As previously discussed, additional weld joints can decrease fatigue life. Therefore, as described herein, the number of weld joints can be decreased by minimizing the number of changes in wall thickness. For example, each tube section can have a length that is maximized. In certain embodiments, the tube does not have a tube section that is less than 1,500 feet long. In further embodiments, the average length of the tube sections is greater than 2,500 feet along the entire length of the tube. In further embodiments, the average length of tube sections is greater than if there were taper changes in the tube.

In certain embodiments, the starting coiled tube is unspooled at one end of the process, then it moves continuously through the heat treatment process and is spooled again on the other end. The spooling devices can be designed to allow rapid changes in spooling velocity, and they can be moved to follow the coiled tube in order to change the spooling or un-spooling velocity in longitudinal units of tube per unit time even more rapidly (flying spooling).

Figure 4:
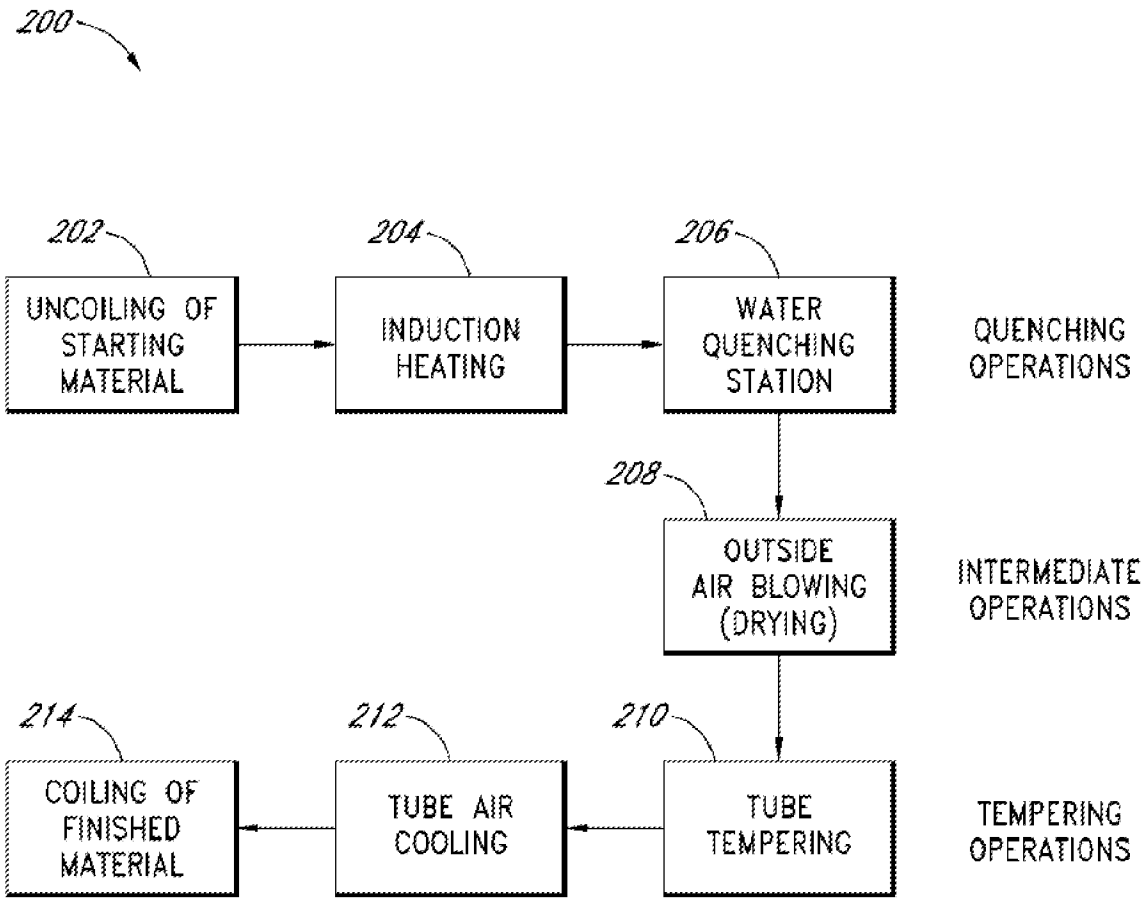
FIG. 4 is a flow diagram of an embodiment of a method of using a continuous and dynamic heat treatment process.

The CDHT itself can include a series of heating and cooling devices that can easily change the heating and cooling rate of the material. In one example, the material is quenched and tempered dynamically, and FIG. 4 is an example flow diagram of the method 200. The method 200 can include quenching operations, intermediate operations, and tempering operations. In operational block 202, a coiled tube of a starting material is uncoiled. In operational block 204, the tube moves through a heating unit and then, in operational block 206, is quenched with water from the outside. The heating unit can modify the power in order to compensate for the changing mass flow when the tube's outer diameter and wall thickness changes, keeping productivity constant. It can also modify the power if the linear speed is changed when the tempering cycle is adjusted, keeping quenching temperatures constant but final properties different. In operational block 208, the tube can be dried.

The tempering operation can include a heating unit and a soaking unit. For example, in operational block 210, the tube can be tempered, and in operational block 212 the tube can be cooled. The stands of the soaking unit could be opened and ventilated so they can rapidly change the total length (e.g., time) of soaking, and at the same time, they can rapidly change the soaking temperature. At the exit of the soaking line, different air cooling devices can be placed in order to cool the tube to a coiling temperature at which there will not be further metallurgical changes. The control of the temperature and speed allows estimating the exact properties of the complete coiled tube, which is an advantage over certain conventional coiled tubes where testing is performed and properties can be only measured in the end of the spools. In certain conventional coiled tubes, the mechanical properties are estimated from less precise models for hot rolling at the hot rolled coil supplier as well as cold forming process during electrical resistive welding (ERW) forming. In operational block 214, the tube can be coiled onto a spool.

The resulting coiled tube can have a variety of configurations. In certain embodiments, a coiled tube includes a first substantial portion of the tube having a first set of properties, and a second substantial portion of the tube having a second set of properties such that at least one property of the first set of properties is different from at least one property of the second set of properties. Furthermore, the coiled tube may have more than two substantial portions. For example, the coiled tube may have a third substantial portion of tube which have a third set of properties such that at least one property of the third set is different from at least one property of the first set of properties and at least one property of the second set of properties. A substantial portion described herein may be a portion with a sufficient size (e.g., length) to enable measurement of at least one property of the portion. In certain embodiments, at least one property of the coiled tube varies continuously (e.g., near infinite number of portions).

In some embodiments, the first substantial portion of the tube has a first length between 1000 feet and 4000 feet (or between about 1,000 feet and about 4,000 feet), and the second substantial portion of the tube has a second length of at least 4000 feet (or at least about 4,000 feet). The first and second substantial portions may also have other various lengths.

In certain embodiments, at least one property of the first and second set of properties including yield strength, ultimate tensile strength, fatigue life, fatigue strength, grain size, corrosion resistance, elastic modulus, hardness, or any other properties described herein. Furthermore, a change of mechanical properties (e.g., yield strength) could allow a change in weight of the coiled tube.

In certain embodiments, the tube has fewer changes in wall thickness as a result in the varied properties along the length of the tube in comparison to conventional tube without the varied properties in order to maintain sufficient properties for a particular application. The tube may even have a substantially constant wall thickness throughout the tube.

In certain embodiments, the tube has a substantially uniform composition throughout the tube. For example, the tube may have tube segments that were welded together that do not have significant differences in composition (e.g. tube segments with substantially similar composition). Tube segments can include either (1) tube segments that appear welded together since they were made by welding flat strips, formed into a tube, and welded longitudinally or (2) tube segments that are welded together after being formed into tubes and longitudinally welded.

EXAMPLES

The following examples are provided to demonstrate the benefits of the embodiments of the disclosed CDHT and resulting coiled tube. For example, as discussed below, coiled tube may be heat treated to provide coiled tube with overall unique properties. These examples are discussed for illustrative purposes and should not be construed to limit the scope of the disclosed embodiments.

Example 1

As an example, a steel design that is quenched and tempered could include sufficient carbon, manganese and could include chromium or molybdenum or combinations of boron and titanium, and be quenched and tempered at different temperatures. Various other steel compositions such as those described above can also be quenched and tempered in similar methods. In the example below, the coiled tube is comprised of about 0.23 to about 0.28 wt. % carbon, about 1.20 to about 1.60 wt. % manganese, about 0.15 to about 0.35 wt. % silicon, about 0.015 to about 0.070 wt. % aluminum, less than about 0.020 wt. % phosphorus, less than about 0.005 wt. % sulfur, and about 0.15 to about 0.35 wt % chromium. The amount of each element is provided based upon the total weight of the steel composition.

Figure 5:
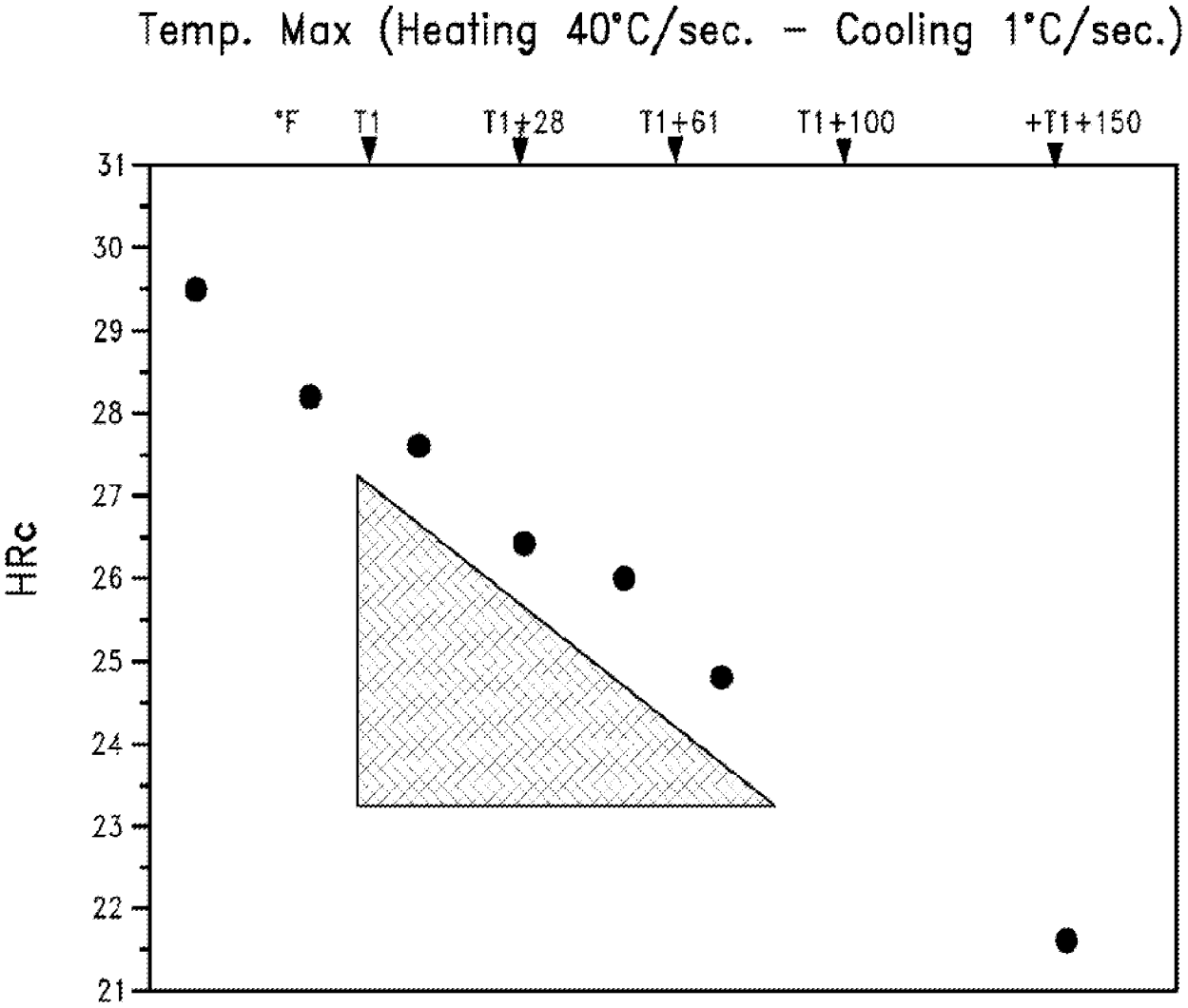
FIG. 5 is a plot of Rockwell C hardness (HRC) as a function of maximum temperature for tempering cycles which include heating and cooling at 40° C./sec and 1° C./sec, respectively.

Laboratory simulations and industrial trials were used to measure the material response to quench and tempering cycles. The lengths were selected to guarantee uniform temperatures (more than 40 feet per condition, the material moved continuously through heating and cooling units in the industrial test and was stationary in the lab simulations). The material was subjected to tempering cycles of different maximum temperatures by heating by induction at 40° C./sec up to the maximum temperature and then cooling in air at 1° C./sec (see FIG. 5 which shows the variation of hardness measured in Rockwell C scale (HRC) of the material as a function of maximum temperature). T1 in FIG. 5 is a reference temperature (about 1050° F. in this example) that results in a hardness of about 27.5 HRC. The reference temperature and resulting hardness can vary depending on steel composition. These particular cycles did not have a soaking time at the maximum temperature (e.g. the material was not held at the maximum temperature for any significant time), but equivalent cycles at lower temperatures and for longer time could be applied. The material was previously water quenched to the same starting hardness level and to a microstructure composed of mainly martensite (more than 80% in volume).

By applying these tempering cycles, the final properties (e.g. yield strength) could be controlled from 80 to 140 ksi allowing the production of different final products. As indicated by the slope of the hardness as a function of temperature graph in FIG. 5, four points of hardness variation (approximately 11 ksi variation in tensile strength) can be produced if the maximum temperature is varied by more than 70° C. (e.g., hatched triangle in FIG. 5). The tensile strength is related to hardness, and discussion of the relationship can be found, for example, in Materials Science and Metallurgy, by H. Pollack, 4.sup.th edition, 1988, Prentice Hall, page 96, Table 3, shows that a 22.8 HRC is equivalent to 118 ksi and 26.6 HRC is equivalent to 129 ksi. A hardness difference of 3.8 HRC is 11 ksi in tensile strength. Certain other quench and tempered steels have also been observed to have a similar relationship. This temperature variation is much larger than the control capability of the tempering furnaces, and this example indicates that the tensile strength could be controlled at any point of the tube to much less than a 11 ksi variation. In a standard product without heat treatment, the mechanical properties variation along the length of a hot-rolled coil can be 11 ksi and between coils up to 15 ksi, so the mechanical properties of a standard product may vary along the length of the tube but in an uncontrolled way. In addition, in the standard product, these properties may vary as the tube is formed to different diameters; while in the case of the CDHT tubes these properties can remain constant with chemistry.

As demonstrated, the composite tube produced by a dynamic control of heat treatment process can have precisely selected properties that vary in a controlled fashion in each section of the tube. Calibration curves for the material used in this process allows controlling the exact properties at each location of the tubes by recording the temperature. Similar experiments on other compositions of tube can be used to create calibration curves which can then be used to create process parameters of the CDHT process to produce a coiled tube with select properties along the length of the tube. In addition, tempering models can be used to select processing conditions that could yield select properties along the length of the tube by varying parameters such as time and temperature. For example, Hollomon et al., "Time-temperature Relations in Tempering Steel," Transactions of the American Institute of Mining, 1945, pages 223-249, describes a classical tempering model approach. Hollomon describes that the final hardness after tempering of a well quenched material (high % of martensite) is a function of a time-temperature equation that varies with the type of steel. This model can be used to calculate the final hardness of a material after tempering for any combination of time and temperatures after generating some experimental data. The calibration curves for a tempering process can be generated after the model has been fitted with the experimental data.

In order to dynamically change the properties, the temperature can be increased rapidly or decreased rapidly using induction heating, air cooling or changing the soaking time (if the cycle of tempering uses temperature and a soaking time and not only temperature as is the case for the example in FIG. 5). This process can be used to generate a unique coiled tube product with varying properties that are changed in order to optimize its use as shown in the examples below. The heat treated microstructure can be much more refined and homogeneous than the hot-rolled microstructure, which can provide improved corrosion and fatigue performance. The heat treatment can also relieve internal stresses of the material, which were generated during forming (e.g., hot-rolling and pipe forming).

Example 2

In certain applications, a coiled tube may be required to operate in wells of up to 22,500 ft deep. The tube minimum wall thickness may be 0.134" and the tube OD may be 2.00". The material may also have good performance in H.sub.2S containing environments and good fatigue life.

If the tube is designed for axial load, without taper changes and with a safety factor of 70%, the material may have a Specified Minimum Yield Strength (SMYS) of at least 110 ksi:

$$0.70 \times SMYS = A\,(\text{area}) \times L\,(\text{length}) \times \text{Density}/A = L \times \text{Density}$$

$$SMYS = L \times \text{Density}/0.70 = 22{,}500\ \text{ft} \times (0.283\ \text{lb/in.}sup.3) \times (12\ \text{in/ft})/0.70$$

$$SMYS \approx 110{,}000\ psi$$

Figure 6:
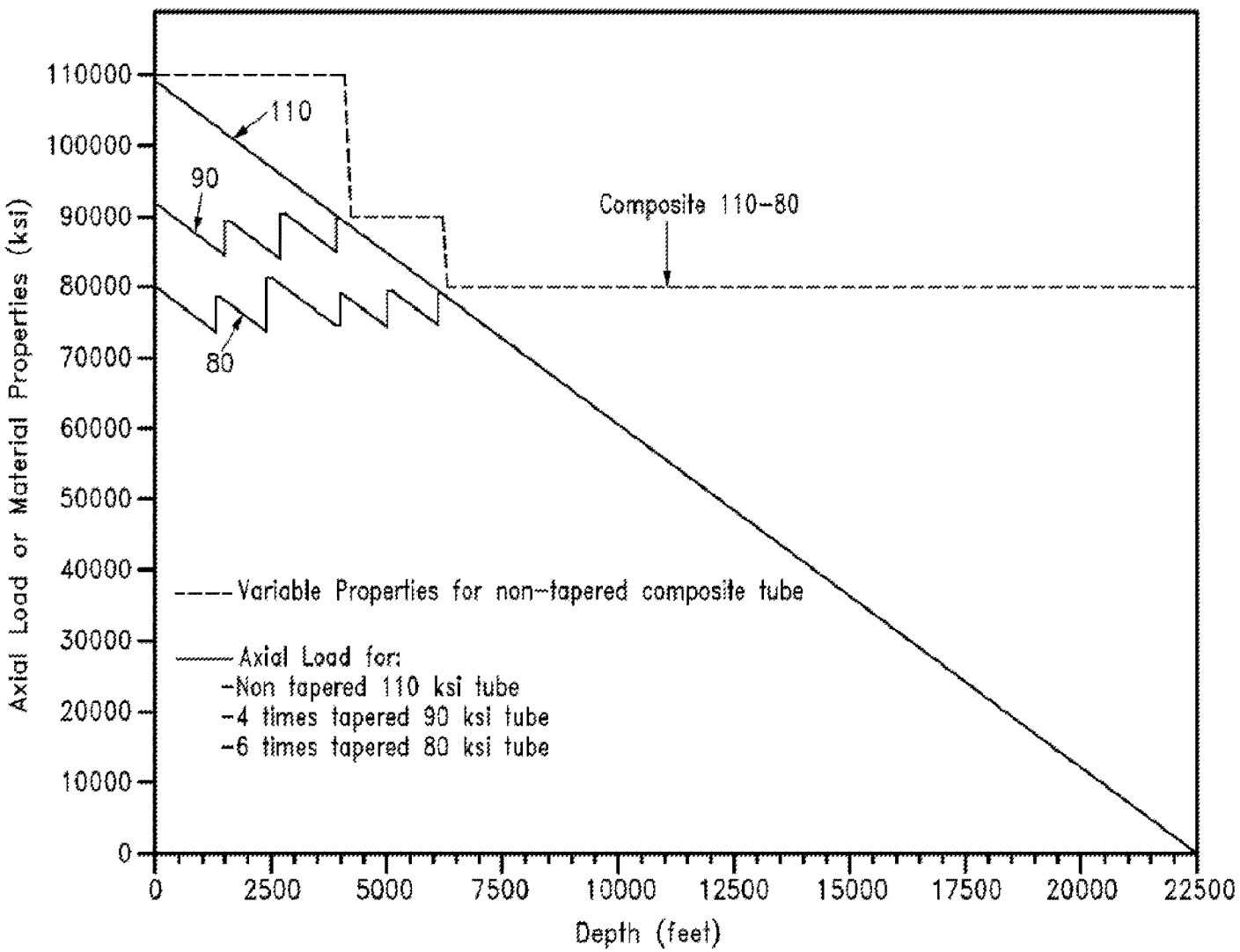
FIG. 6 is a plot of an example of required mechanical properties for a coiled tube as a function of depth from a well surface (0 ft) to a bottom of the well (22,500 ft) for a 110 ksi tube without being tapered, a four tapered 90 ksi tube, and a six tapered 80 ksi tube; also the dashed line shows mechanical properties for an embodiment of a composite tube without being tapered.

The density value was estimated as the density of iron of about 0.283 lb/in.sup.3. This indicates that if the tube is designed to have a yield strength of 110 ksi, the cross section at the top of the well will be capable of withstanding the weight of the coiled tube. If the same coiled tube is produced with material having a SMYS of 90 or 80 ksi, it may be necessary to taper the upper length of the coiled tube in order to increase the resistance area "A" (e.g. the wall thickness of the coiled tube is increased in the section closer to the well surface compared to the section of the coiled tube closer to the well bottom. FIG. 6 shows a full line (see the solid lines in FIG. 6) of the required mechanical properties from the bottom of the well (22,500 ft) to the well surface (0 ft) for a 110, 90 and 80 ksi coiled tube. As illustrated in FIG. 6, by performing wall thickness changes (e.g. tapers) (which are generally restricted to a number of standard thicknesses produced by the steel rolling mill), the resulting tapered coiled tube could be built with 110, 90 or 80 ksi material (when the whole coiled tube is manufactured in only one type of material).

If a composite coiled tube is defined with the properties varying as indicated by the dotted line in FIG. 6, the well could be serviced since the properties vary to improve the overall performance of the coiled tube as indicated in Table II below. The estimation of relative fatigue life and pumping pressure (calculated relative to the composite coiled tube) in Table II is defined based on models used for prediction of service life and current standards. For example, as illustrated in FIG. 6, the tube can have a yield strength of at least 110 ksi to a depth of about 4,000 feet, a yield strength of at least 90 ksi to a depth of about 6,500 feet and a yield strength of at least 80 ksi at depths greater than about 6,500 feet.

TABLE II

| Example | # of taper changes | # of weld joints | Internal Flash Removal (Y/N) | Relative weight | Relative pumping pressure | Relative fatigue life | SSC resistance | Cost |
|---|---|---|---|---|---|---|---|---|
| 110 ksi coiled tube | 0 | 9 | Y | 100.0% | 100.0% | 80.0% | Worst | Highest |
| 90 ksi coiled tube | 4 | 11 | N | 103.1% | 102.8% | 53.3% | Medium | Medium |
| 80 ksi coiled tube | 7 | 12 | N | 107.5% | 107.5% | 48.9% | Best | Medium |
| Composite coiled tube | 0 | 9 | Y | 100.0% | 100.0% | 100.0% | Best | Lowest |

Internal flash removal refers to the elimination of the material that is expulsed from the weld during the ERW process. This material can only be removed if the taper changes are reduced to zero (e.g. taper changes can restrict or prevent the removal of flash). The presence of the flash can affect the fatigue life as well as the ability to inspect the tube.

The best coiled tube is the composite coiled tube because, while keeping the number of taper changes to zero and the tube weight to a minimum, it has lower mechanical properties down the coiled tube, improving the fatigue life as well as the resistance to embrittlement in H.sub.2S environments by SSC. Furthermore, the cost of the raw material for the composite coiled tube can be lower. An "all 80 ksi" coiled tube will have similar resistance to SSC but with 7.5% weight increase, while and "all 110 ksi" material will have similar weight and no taper changes but lower fatigue and SSC resistance.

In addition, the number of weld joints between tube sections can be minimized. As shown in Table II, the number of tube sections was higher for 90 ksi coiled tube and 80 ksi coiled tube because of the wall thickness changes (e.g., tapers). The additional tapers can reduce the fatigue resistance of the tube. In certain embodiments, the average length of the tube sections is greater than 2500 feet along the entire length of the tube. In further embodiments, the average length of tube sections is greater than if there were taper changes in the tube.

The composite coiled tube, by minimizing the number of tapers, also increases the coiled tube capacity and volume, as well as reliability of inspection, using a drift ball for example. The internal flash removal with no tapers is also possible if desired.

For a tapered coiled tube, the increased wall thickness reduces the inner diameter and results in higher pumping pressure for the same volumetric flow rate. Higher pumping pressure will both increase the energy required for pumping and reduce the fatigue life by increasing internal stresses. Therefore, the composite product described herein can have optimized properties and improved properties over a tapered coiled tube.

Pumping pressure can be a function of tube length and inside diameter, and pumping pressure can be calculated using well-known fluid mechanics relationships. Therefore, by increasing the inside diameter of the tube, the pumping pressure can be reduced for a certain flow rate. Furthermore, fatigue life can be affected by many factors including the tube yield strength, the internal pressure, and others. The example tubes described herein can have improved fatigue life by having a combined effect of selecting yield strength, decreasing internal pressure (e.g., pumping pressure), and decreasing number of strip to strip welds. SSC resistance can be assessed in accordance with NACE TM0177 and NACE MR0175. One strong correlation in C—Mn steels is the relationship between hardness and SSC resistance. As previously discussed, in general, steel with a higher hardness results in lower SSC resistance. Also in general, steel with a higher strength has a higher hardness which results in a lower SSC resistance. The composite coiled tube can have lower strength tube confined to the lower part of the coiled tube where the SSC exposure is higher. Furthermore, the composite coiled tube can have high strength tube confined to the upper part of the coiled tube where the SSC exposure is less.

The properties after a heat treatment are affected by the time and temperature history of the material, making the process subject to validation. The validation process is supported by metallurgical models that allows for the correct prediction of tube properties at each section of the coiled tube. In the certain conventional coiled tubes, the properties along the length of the coiled tube depend on hot rolled schedule at the steel supplier, sequence of coil splicing (since not all coils are equal), as well as the cold forming process at tube mill. The composite heat treated coiled tube is much more reliable than the standard coiled tube. For example, the properties of the composite heat treated coiled tube can be more consistent since the properties primarily depend on the heat treatment process while conventional coiled tubes have many variables that result in large variations in properties between sections of the coiled tube and also between different coiled tubes.

This example is just one possible method of heat treating a coiled tube to maximize the performance of the coiled tube. Customers may have other needs and other methods can be designed to produce a tailor made coiled tube to a customer's needs. How to design a heat treatment profile to produce a particular coiled tube should be apparent from the above example and further description herein.

Example 3

In another example, the coiled tube is produced by hot rolling a coiled tube of a different starting outer diameter (OD) (e.g., by using a standard hotstretch reducing mill that is fed by a starting coiled tube with different OD and wall thickness than the exiting coiled tube). The properties of the starting coiled tube are defined by the thermo mechanical control rolling process (TMCP) at the hot rolling mill and the subsequent cold working at the tube mill. During the coiled tube hot rolling process, the properties decrease since the hot rolling milling of the tube could not reproduce the TMCP. The continuous heat treatment process could be used to generate new properties on the coiled tube, and in particular, to vary the properties in order to improve the overall performance of the coiled tube. These property variations could not be generated during the hot rolling since the property changes are affected by the degree of reduction during rolling.

Example 4

During hot rolling, the final properties are affected by the schedule of reduction at the hot rolling mill as well as the cooling at the run out table and final coiling process. Since the water in the run out table could generate differing cooling patterns across the width of the hot rolled coil, a faster cooling on coil edges and variations along the length due to "hot lead end practices" to facilitate coiling, as well as differential cooling of the inside of the coil with respect to the ends, the properties of the tubes would inherit these variations. In the case of the heat treated coiled tubes, the variation of properties are mainly affected by the chemistry and hence occur at a heat level (e.g., a heat size is the size of the ladle in the steelmaking process and hence is the maximum volume with same chemistry produced by a batch steelmaking process). The variation of properties of the composite heat treated coiled tube could be under control by having improved control of the heat treatment (heating, soaking, cooling, etc. (e.g., rate and time)) along the length of the coiled tube.

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion.

The invention claimed is:

1. A method of forming and heat treating a coiled tube, the method comprising:

welding a plurality of steel strips together end-to-end to form a plurality of end-to-end welded strips and longitudinally welding the plurality of end-to-end welded strips to form a tube with a substantially constant inner diameter, outer diameter, and wall thickness along at least a first portion, a second portion, and a third portion, the third portion being disposed between the first portion and the second portion, said tube having one or more microstructures; and after forming the tube, performing a continuous and dynamic heat treatment (CDHT) process comprising a continuous quench and temper heat treatment along the first portion, the second portion, and the third portion, thereby modifying the one or more microstructures of the tube and thereby resulting in a post heat treatment (PHT) tube with a second microstructure comprising a uniformity of microstructure across (a) the plurality of steel strips, (b) a plurality of end-to-end welds joining the steel strips, and (c) a plurality of longitudinal welds joining the plurality of steel strips, and wherein the PHT tube after the continuous quench and temper process has at least 80% tempered martensite in the first, second, and third portions of the PHT tube; and coiling the PHT tube to form a coiled tube.

2. The method of claim 1, wherein the step of coiling the PHT tube to form a coiled tube comprises coiling the PHT tube on a spool.

3. The method of claim 1, further comprising:

after forming the tube, coiling the tube on a spool;

uncoiling the tube from the spool prior to performing the CDHT process;

performing the CDHT process; and after performing the CDHT process, re-coiling the PHT tube.

4. The method of claim 1, wherein the plurality of steel strips have a substantially uniform steel composition along the first portion, the second portion, and the third portion.

5. The method of claim 1, wherein the PHT tube has a tempered martensite microstructure along substantially its entire length.

6. The method of claim 1, wherein performing the continuous quench and temper heat treatment process comprises translating the tube through a heat treatment system that performs heating action, cooling action, or both.

7. The method of claim 6, wherein translating the tube is at variable speeds.

8. The method of claim 1, wherein performing the continuous quench and temper heat treatment process comprises at least one quenching operation, intermediate operation, and tempering operation.

9. The method of claim 1, wherein at least one parameter of the continuous quench and temper process is selected from a group consisting of temperature, soak time, heating rate, and cooling rate.

10. The method of claim 1, wherein at least one parameter of the continuous quench and temper process is selected from a group consisting of at least two of temperature, soak time, heating rate, and cooling rate.

11. The method of claim 1, wherein a yield strength of one of the first, second, and third portions of the tube is between 80 ksi and 140 ksi.

12. The method of claim 1, wherein the first portion is configured to be positioned at a top of a wellbore and has a length of at least 1,000 feet and the second portion is configured to be positioned toward a bottom of the wellbore relative to the first portion and has a length of at least 1,500 feet and the third portion has a length of at least 1,500 feet and a total length of the coiled tube is between 10,000 feet and 40,000 feet.

13. The method of claim 1, further comprising providing a plurality of steel strips to be welded together, each of the strips including from about 0.010 wt. % to about 0.025 wt. % titanium and from about 0.0010 wt. % to about 0.0025 wt. % of boron.

14. The method of claim 13, wherein the step of providing a plurality of steel strips to be welded together, comprises each of the steel strips including from about 1.30 wt. % to about 1.50 wt. % manganese.

15. The method of claim 13, further comprises providing a plurality of steel strips to be welded together, each of the plurality of steel strips including from about 0.15 wt. % to about 0.35 wt. % silicon.

16. The method of claim 13, further comprises providing a plurality of steel strips to be welded together, each of the plurality of steel strips including less than about 0.005 wt. % sulfur.

17. The method of claim 13, further comprises providing a plurality of steel strips to be welded together, each of the plurality of steel strips including from about 0.015 wt. % to about 0.070 wt. % aluminum.

18. The method of claim 13, further comprises providing a plurality of steel strips to be welded together, each of the plurality of steel strips including less than about 0.020 wt. % phosphorus.

19. The method of claim 13, further comprises providing a plurality of steel strips to be welded together, each of the steel strips including from about 0.15 wt. % to about 0.35 wt. % chromium.

20. The method of claim 19, further comprises providing a plurality of steel strips to be welded together, each of the steel strips including from about 1.20 wt. % to about 1.60 wt. % manganese.

* * * * *